US005704514A

United States Patent [19]

Schoo

[11] Patent Number: 5,704,514

[45] Date of Patent: Jan. 6, 1998

[54] COMPOSITE PRESSURE VESSEL

[76] Inventor: Raul Alberto Iglesias Schoo, Bolivar 547, Piso 6, 1066 Buenos Aires, Argentina

[21] Appl. No.: 542,803

[22] Filed: Oct. 12, 1995

Related U.S. Application Data

[63] Continuation of Ser. No. 132,574, Oct. 6, 1993, Pat. No. 5,462,193.

[51] Int. Cl.[6] ..... B65D 7/02

[52] U.S. Cl. ..... 220/652; 220/89.1

[58] Field of Search ..... 220/652, 653, 220/89.1, 581, 592

[56] References Cited

U.S. PATENT DOCUMENTS

| | | | |
|---|---|---|---|
| 584,068 | 6/1897 | Weber | 220/653 |
| 3,062,402 | 11/1962 | Farrell et al. | 220/653 |
| 3,124,265 | 3/1964 | Bertels | 220/653 |
| 3,712,139 | 1/1973 | Harvey | 220/653 |
| 4,193,510 | 3/1980 | Weston | 220/652 |
| 5,462,193 | 10/1995 | Schoo | 220/652 |

FOREIGN PATENT DOCUMENTS

| | | | |
|---|---|---|---|
| 1471167 | 3/1967 | France | 220/653 |

*Primary Examiner*—Joseph M. Moy

*Attorney, Agent, or Firm*—Lackenbach Siegel Marzullo Aronson & Greenspan, P.C.

[57] ABSTRACT

A composite pressure vessel, for the containment of pressurized fluid, having at least two opposed wall regions, and a plurality of internal fibers fixedly attached to and extending between the at least two opposed wall regions, interiorly of the pressure vessel, so as to resist the force of the pressurized fluid tending to force the at least two opposed wall regions apart. The fibers are disposed between the at least two opposed wall regions, and comprise a single fiber threaded through and between apertures defined in the at least two opposed wall regions so as to lace together the at least two opposed wall regions; and the apertures are of rounded funnel shape with a narrow channel at a proximal end thereof leading into said pressure vessel and with an enlarged portion at an opposite, distal end thereof, said apertures being spaced from one another so as to form a convex, rounded cross-section over which said single fiber is placed when said single fiber is threaded from one aperture to an adjacent aperture.

15 Claims, 7 Drawing Sheets

COMPOSITE PRESSURE VESSEL

This is a continuation of application Ser. No. 08/132,574 filed Oct. 6, 1993 now U.S. Pat. No. 5,462,193.

BACKGROUND OF THE INVENTION

1. Field of the Invention

The present invention relates to pressure vessels generally and, more particularly, but not by way of limitation, to a novel pressure vessel of composite construction.

2. Background Art

Since the beginning of the industrial revolution, there has been a necessity for providing containers to hold fluids under pressure in a variety of processes. Most present day pressure vessels are of cylindrical or spherical shape and of welded or seamless construction. Because of the design considerations for rectilinear pressure vessels, the wall thicknesses thereof are quite large even at relatively low working pressures. At very high working pressures, the wall thicknesses of even cylindrical or spherical pressure vessels can become quite large, with a concomitant heavy weight of the vessels. This makes such conventional pressure vessels unsuitable for applications in which heavy weight is a detriment, for example, in the aerospace industry.

A further disadvantage of conventional pressure vessels is that their cylindrical or spherical shapes, while making efficient use of the materials of which they are constructed, are inefficient in space utilized. For example, a number of cylinders stacked together have a considerable amount of free space between them. For another example, a tank truck having a cylindrical tank, with the diameter limited by trucking regulations, can hold much less fluid than would a rectangular shaped tank subject to the same regulations.

Accordingly, it is a principal object of the present invention to provide a pressure vessel of less weight than one of conventional construction.

It is a further object of the invention to provide such a pressure vessel that can be of rectilinear shape, yet not have excessive wall thickness.

It is an additional object of the invention to provide such a pressure vessel that is economical to construct.

Other objects of the present invention, as well as particular features, elements, and advantages thereof, will be elucidated in, or be apparent from, the following description and the accompanying drawing figures.

SUMMARY OF THE INVENTION

The present invention achieves the above objects, among others, by providing, in a preferred embodiment, a composite pressure vessel for the containment of pressurized fluid, comprising: at least two opposed walls regions; and a plurality of internal fibers fixedly attached to and extending between said at least two opposed wall regions, interiorly of said pressure vessel, so as to resist the force of said pressurized fluid tending to force said at least two opposed wall regions apart.

BRIEF DESCRIPTION OF THE DRAWINGS

Understanding of the present invention and the various aspects thereof will be facilitated by reference to the accompanying drawing figures, submitted for purposes of illustration only and not intended to define the scope of the invention, on which.

DETAILED DESCRIPTION OF THE PREFERRED EMBODIMENTS

Figure 1:
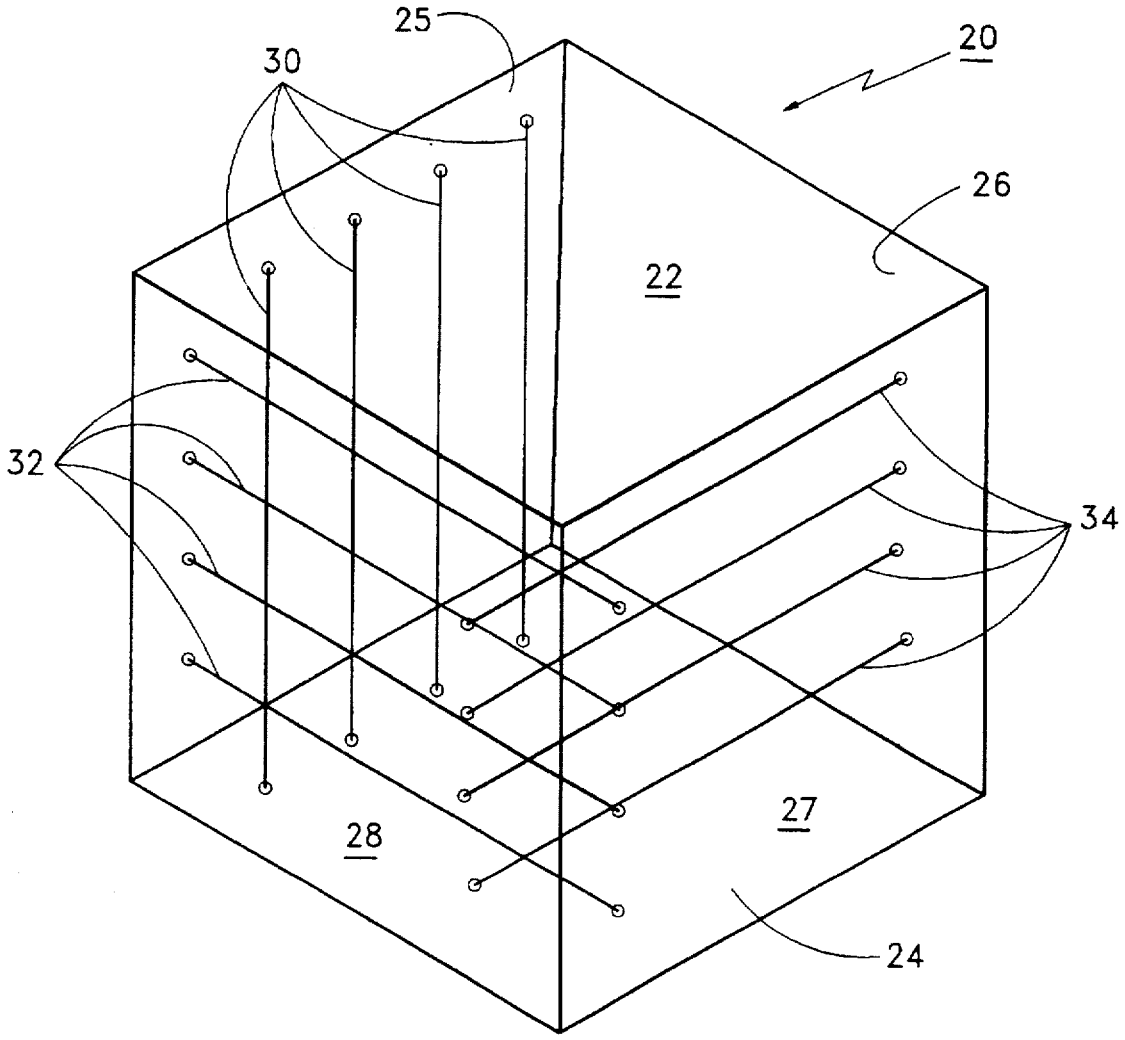
FIG. 1 is a schematic, isometric view of a pressure vessel, illustrating one aspect of the present invention.

Reference should now be made to the drawing figures, on which similar or identical elements are given consistent identifying numerals throughout the various figures thereof, and on which parenthetical references to figure numbers direct the reader to the view(s) on which the element(s) being described is (are) best seen, although the element(s) may be seen also on other views.

FIG. 1 schematically illustrates one aspect of the present invention, here applied to a transparent quadrilateral pressure tank, generally indicated by the reference numeral 20. Tank 20 includes top and bottom walls 22 and 24, respectively, and four side walls 25, 26, 27, and 28. Interiorly of tank 20 are a plurality of vertical fibers 30 attached to and extending between top and bottom walls 22 and 24, a plurality of horizontal fibers 32 attached to and extending between side walls 25 and 27, and a plurality of horizontal fibers 34 attached to and extending between side walls 26 and 28. For clarity, only three each of fibers 30, 32, and 34 are shown; however, in most cases, there would be a much greater number of such fibers and they would be evenly distributed between the surfaces they join. Fibers 30, 32, and 34 are offset from one another so as not to intersect within tank 20.

It will be understood from inspection of tank 20, as shown on FIG. 1, that the pressure of a fluid (not shown) in the tank tending to force opposite wall elements thereof apart will translate, in part, to tensile force on fibers 30, 32 and 34 which are disposed between opposite wall pairs 22/24, 25/27, and 26/28, respectively, of the tank. Depending on the numbers and diameter of fibers 30, 32, and 34, the thicknesses of the wall elements can be considerably less than they would be for a conventionally constructed quadrilateral tank (eg. a cuboidal or rectangular tank) designed for the same working pressure.

Figure 2:
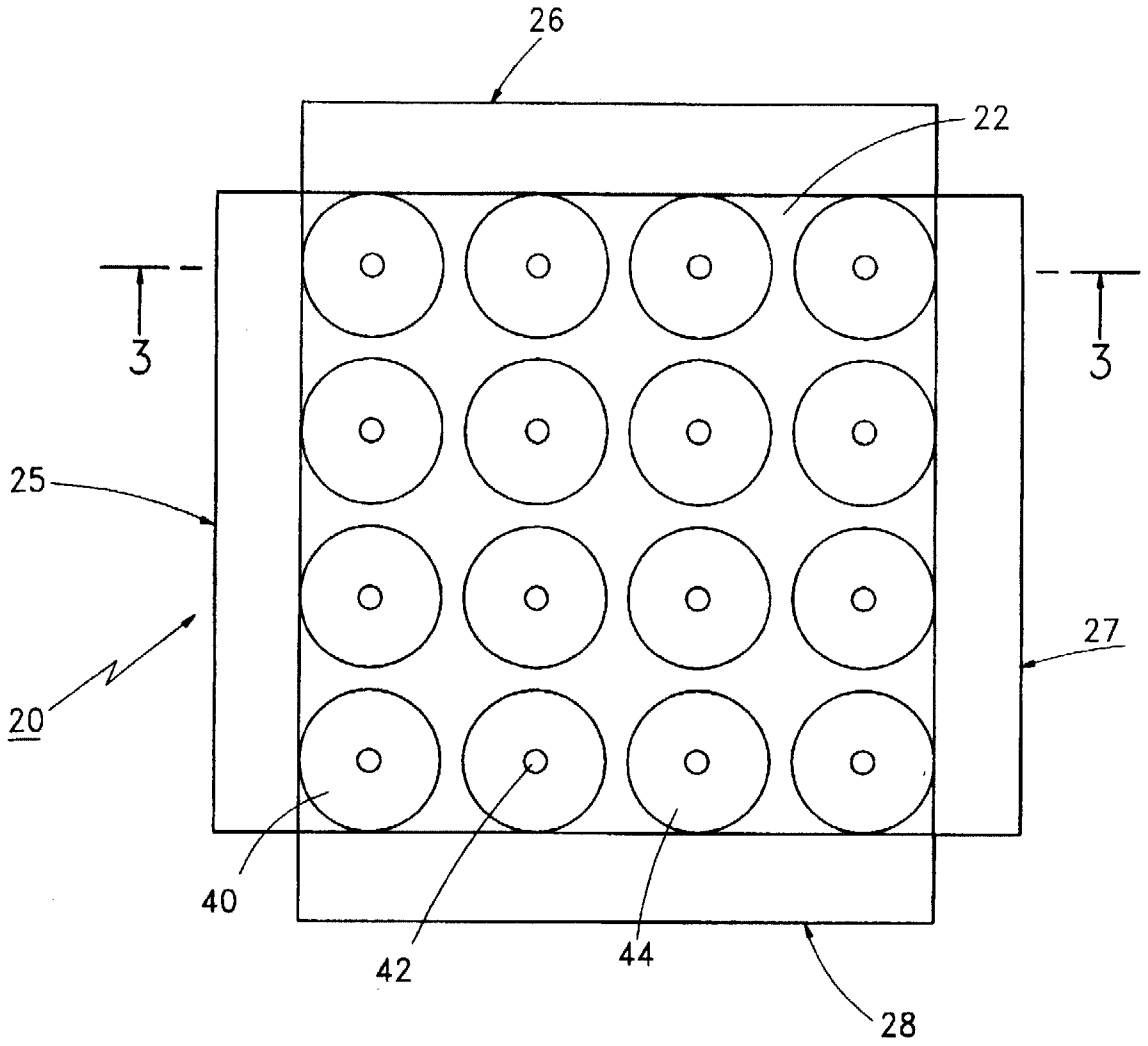
FIG. 2 is a top plan view of an intermediate preform stage in the construction of the pressure vessel of FIG. 1.
Figure 3A:
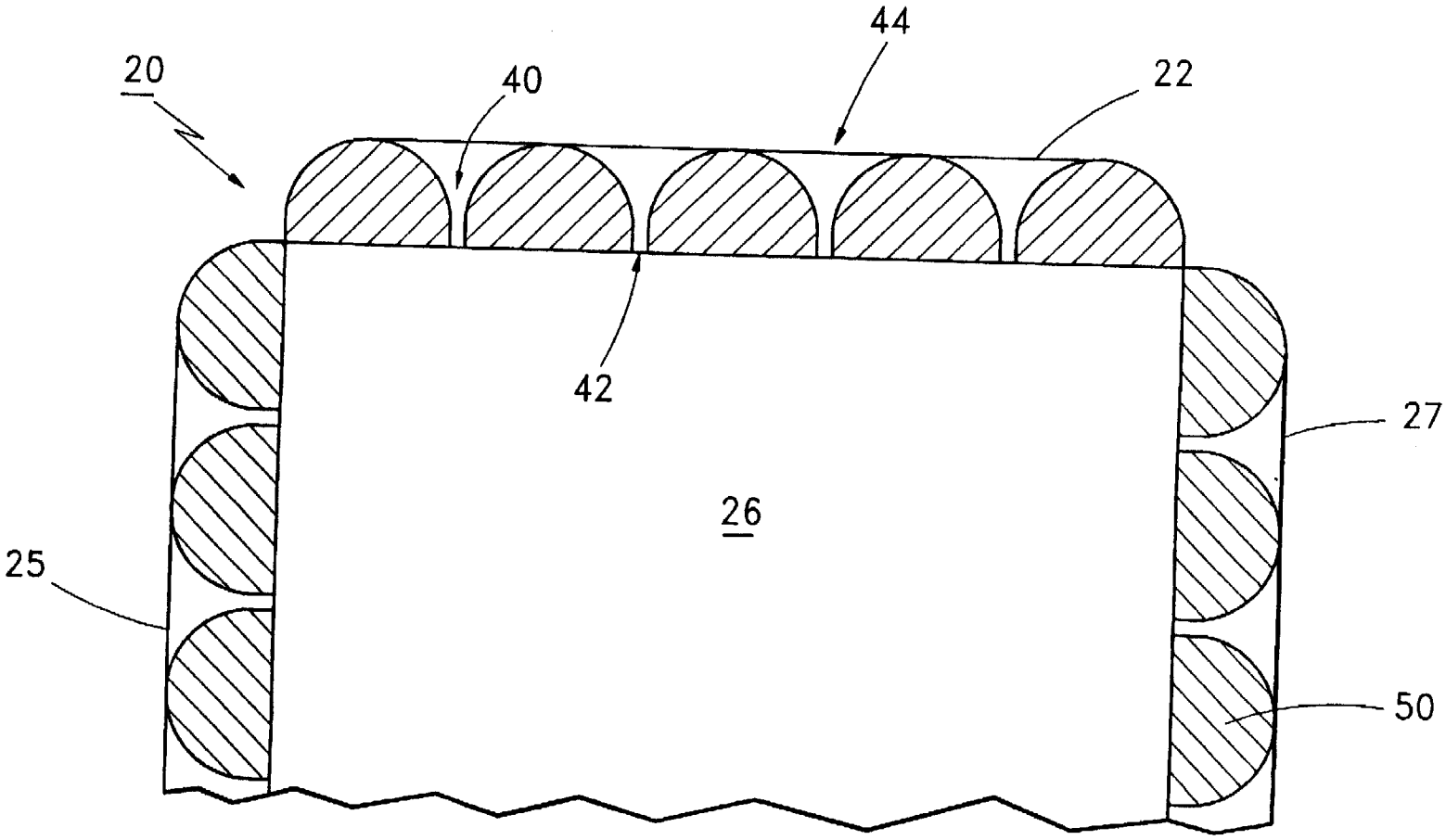
FIG. 3A is a fragmentary, side elevational view taken along line "3—3" of FIG. 2.
Figure 3B:
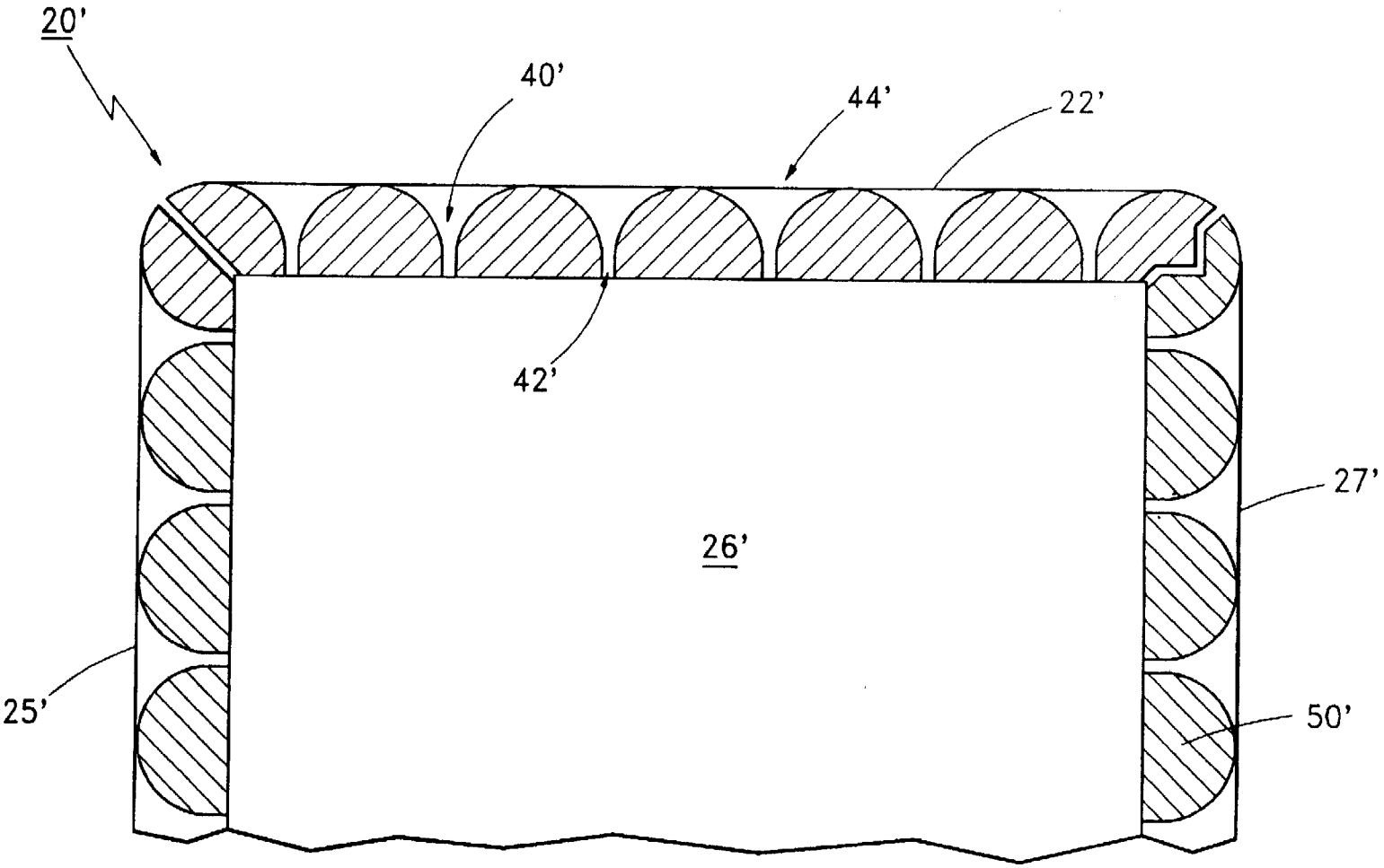
FIG. 3B is a fragmentary, side elevational view taken along line "3—3" of FIG. 2 showing alternative embodiments.

FIGS. 2, 3A and 3B illustrate an intermediate preform stage in the construction of pressure vessel 20 or 20'. Here, top wall 22 (or 22'), bottom wall 24 (or 24')(not shown), and side walls 25–28 (or 25'–28') have been brought together. The foregoing wall elements are shown in FIG. 3A and 3B as being in nontouching relationship and, in such case, they would be temporarily so held by a suitable fixture or jig. Alternatively, the wall elements could be tack welded together or held in place by similar attaching means.

It can be seen that a plurality of rounded, funnel shaped apertures, as at 40 (or 40') (FIGS. 3A and 3B) in top wall 22, have been formed through the wall elements so as to define fairly narrow openings, as at 42 (or 42') in top wall 22 (or 22'), into the interior of pressure vessel 20 (or 20') at the proximal end of the apertures, and to define fairly broad openings, as at 44 (or 44') in top wall 22 (or 22'), at the distal ends of the apertures. Apertures 40 (or 40') are spaced on a square pattern on the wall elements (FIG. 2) so as to define a hemispherical cross-section, as at 50 (or 50') in side wall 27 (or 27'), between narrow openings 42 (or 42') in adjacent apertures. FIG. 3B shows alternative embodiments of pressure vessel 20, generally indicated by reference numeral 20'. It can be seen that the edges of top wall 22' and side walls 25' and 27' form four beveled joints (only one shown) with slight gaps therebetween. The beveled joints may also be provided with interlocking spaced steps in the broken away alternative corner section.

Figure 4:
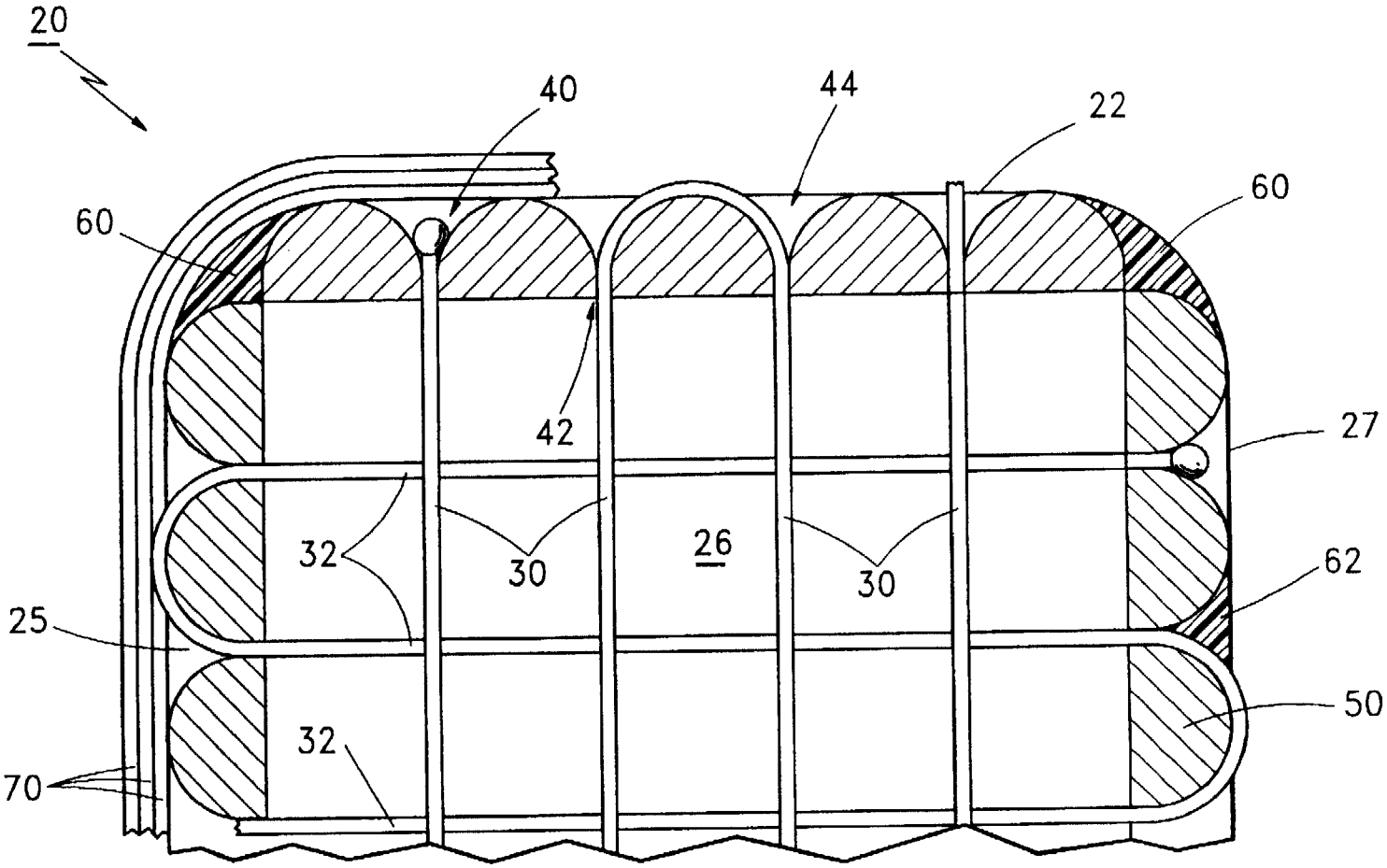
FIG. 4 is FIG. 3A with the construction of the pressure vessel completed.

FIG. 4 is the same view as FIGS. 3A, except with the construction of pressure vessel 20 completed. Fibers 32, which it can be seen is actually a single fiber 32, have been attached to and tautly extended between side walls 25 and 27. The method of so doing is to knot one end of fiber 32 so that end is held in an aperture 40 in side wall 27, then thread the fiber through an opposite aperture in side wall 25, placed over a hemispherical cross-section 50 and threaded through the adjacent aperture in side wall 25, then threaded through an opposite aperture in side wall 27, placed over a hemispherical cross-section and threaded through the adjacent aperture in side wall 27, then threaded through an opposite aperture in side wall 25, etc. When fiber 32 has been threaded through the vertical rows of apertures in side walls 25 and 27 in the plane shown on FIG. 4, the fiber is likewise threaded through the apertures in the adjacent vertical rows until all apertures in those side walls have been threaded by fiber 32.

In a similar manner, fiber 30 is threaded between top wall 22 and bottom wall 24 (not shown).

Preferably, fibers 30, 32, and 34 are pretensioned as they are threaded, so as to minimize bulging of the planar surfaces of pressure vessel 20.

Top wall 22 has been welded and sealed to side walls 25 and 27 by means of a suitable resin material 60. All other joints and corners of pressure vessel 20 will similarly be welded and sealed. The same resin material is used to seal apertures 40, as at 62 in side wall 27. Any unused apertures (if any) will similarly be sealed. Conventional metal welding techniques may also be employed to join and seal top wall 22 to side walls 25 and 27. Thus, all openings through or between elements of pressure vessel 20 are completely sealed.

It will be understood that a fiber 34 (not shown on FIG. 4) will similarly be threaded between side walls 26 and 28 (FIG. 1).

Keeping in mind the above note that fibers 30, 32, and 34 must be offset to as not to intersect each other, it will be understood that apertures 40 in side walls 25 and 27 shown on FIGS. 3A and 4 will be offset somewhat in the depthwise direction on those figures from the apertures in top wall 22, although all the apertures on FIG. 3A and 4 are shown as being in the same vertical plane, for ease of illustration.

Completing the construction of pressure vessel 20, the peripheral surfaces of the pressure vessel are coated with a suitable resin material (not shown) and, then, a plurality of encircling fibers, as at 70, is tautly wrapped around the peripheral surfaces and impregnated with additional resin material. Encircling fibers 70 provide additional reinforcing for pressure vessel 20, thus further reducing the required thicknesses of the wall elements thereof. It will be understood that a similar set of encircling fibers (not shown), in a similar manner, will be wound about the peripheral surfaces of pressure vessel 20 orthogonal to encircling fibers 70.

The wall elements of pressure vessel 20 may be constructed of any suitable metallic or polymeric material compatible with the fluid(s) to be contained therein. Fibers 30, 32, and 34 may be formed from Kevlar, while encircling fibers 70 may be formed of fiberglass. Alternatively, encircling fibers 70 may be formed from Kevlar or they may comprise fiberglass cloth and/or sprayed on chopped fiberglass in resin. The resin materials employed in the construction of pressure vessel 20, such as resin material 60, may be any that are compatible with the fluid(s) to be contained therein and that tightly adhere to the wall elements thereof and to fibers 30, 32, 34, and 70. The thicknesses of the wall elements and the type, diameter, and numbers of fiber elements for a pressure vessel of a particular size and for a given working pressure can be easily determined by calculations known to those skilled in the art.

Apertures 40 or 40' (FIG. 3A and 3B) may be formed with a drill bit having the configuration of the apertures.

Figure 5:
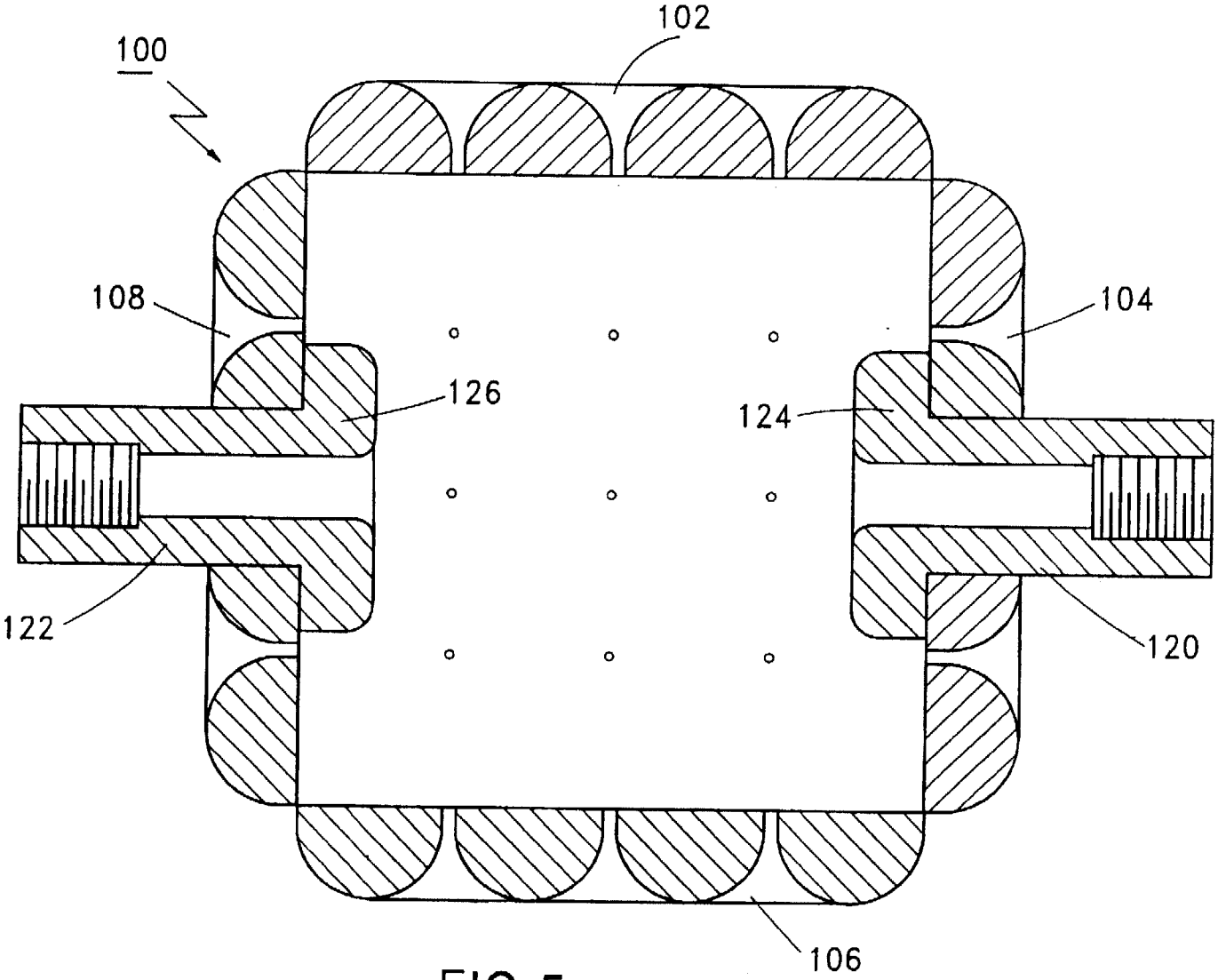
FIG. 5 is a top plan view, in cross-section, of another pressure vessel constructed according to the present invention.

FIG. 5 illustrates a pressure vessel constructed according to the present invention, generally indicated by the reference numeral 100. Pressure vessel 100 is shown in its intermediate preform stage and includes side walls 102, 104, 106, and 108. Disposed in openings defined through side walls 104 and 108 are threaded nozzles 120 and 122, respectively, which may serve as inlet and outlet connections for pressure vessel 100. Nozzles 120 and 122 include inner flanges 124 and 126, respectively, which abut the inner surfaces of side walls 104 and 108 and which may be attached thereto by any suitable means. It will be understood that the provision of nozzles 120 and 122 will mean that one strand of fiber (not shown) between side walls 104 and 108 in pressure vessel 100 will be omitted.

Figure 6:
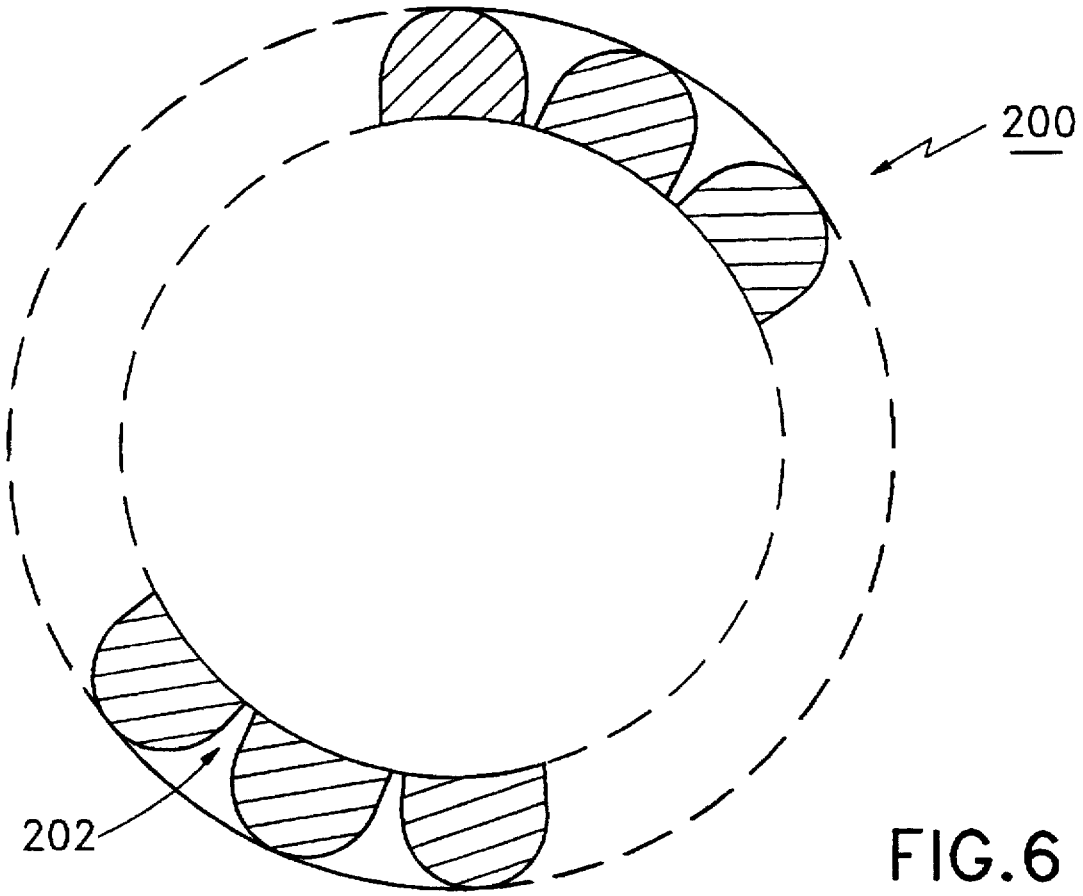
FIG. 6 is a fragmentary, end elevational view of yet another pressure vessel constructed according to the present invention.

Pressure vessels constructed according to the present invention are not limited to quadrilateral vessels, but can be of any rectilinear or other shape. FIG. 6 illustrates a cylindrical pressure vessel, generally indicated by the reference numeral 200, in its intermediate preform stage. Pressure vessel 200 includes a plurality of apertures, as at 202, defined through the wall thereof. It will be understood that the finishing of pressure vessel 200 may be accomplished according to the above teaching with respect to pressure vessel 20 (FIG. 4). Pressure vessel 200 may be finished with conventional concave or convex dished heads (not shown) or it may be finished with flat heads (not shown) according to the present invention.

It will be understood that compound pressure vessels 20 and 200 can be constructed with walls thicknesses much less that pressure vessels of conventional construction. In the case of pressure vessel 20, very little of the quadrilateral volume taken by the pressure vessel is wasted and most of the volume can be used for the fluid contained therein. Over 25 percent more fluid can be held in a tank with a square cross-section than can be held in a cylindrical tank having a diameter equal to the width of the square tank. Compared with a conventionally constructed all-metal tank, the composite tanks according to the present invention can be made considerably lighter in weight.

Figure 7:
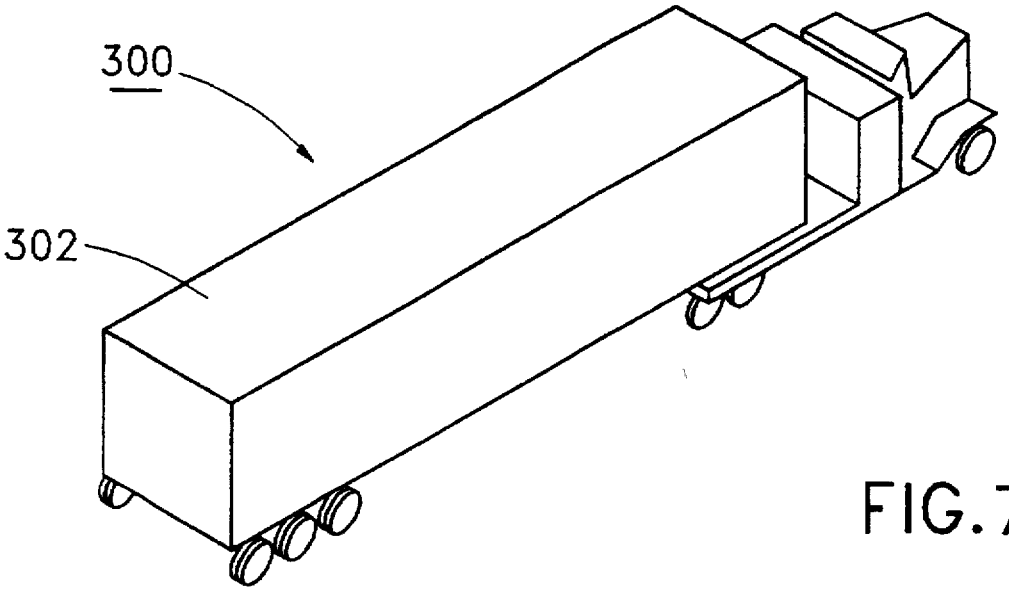
FIG. 7 is a isometric view of a tank truck having a tank constructed according to the present invention.

FIG. 7 illustrates a particular application of the present invention. Here, a tank track, generally indicated by the reference numeral 300, includes a tank 302 constructed according to the present invention. It will be appreciated that tank 302 will hold considerably more fluid in the width and height dimensions permitted by trucking regulations than would a cylindrical tank fitting within the same dimensions. Since the permitted maximum height dimension is generally much greater than the permitted maximum width dimension, this difference in capacities is magnified.

The internal support fibers 30, 32, and 34 shown in FIG. 1 can be a single fiber strand or a twisted or plaited fiber strand. The twisted or plaited fiber strand is preferred over the single fiber strand. The fibers can be made of the same material or of different material as long as they are compatible with each other. The interior support fibers are made of a material which does not corrode or react with the gas or liquid or fluid to be carried in the composite pressure vessel. Synthetic fibers produced from long-chain polyamides (nylons) in which 85% of the amide linkages are attached directly to two aromatic rings called aramids can be used. Nomex and Kevlar from Du Pont Co. and Twaron from Akzo NV are examples of fibers that can be used. The encircling or envelope fibers 70 shown in FIG. 4 are fiberglass or other suitable material that is compatible with resin materials 60 used in the construction of the pressure vessel 20 and is compatible with the fluid or gas to be contained therein. The resin material must tightly adhere to the wall element regions and the fibers 30, 32, 34, and 70. The international standard ASME code for pressure vessels may be used to provide guidelines and construction material selection details that must be considered for designing the pressure vessel based upon the type of use to which it is to be employed.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

I claim:

1. A composite pressure vessel, for the containment of pressurized fluid, comprising:

(a) at least two opposed wall regions;

(b) a plurality of internal fibers fixedly attached to and extending between said at least two opposed wall regions, interiorly of said pressure vessel, so as to resist the force of said pressurized fluid tending to force said at least two opposed wall regions apart;

(c) said fibers being disposed between said at least two opposed wall regions, and comprise a single fiber threaded through and between apertures defined in said at least two opposed wall regions so as to lace together said at least two opposed wall regions;

wherein said apertures are of rounded funnel shape, with a narrow channel at a proximal end thereof leading into said pressure vessel and with an enlarged portion at an opposite, distal end thereof, said aperture being spaced from one another so as to form a convex, rounded cross-section over which said single fiber is placed when said single fiber is threaded from one aperture to an adjacent aperture.

2. A composite pressure vessel, as defined in claim 1, wherein said pressure vessel is cylindrical.

3. A composite pressure vessel as defined in claim 2, wherein said pressure vessel includes a tubular tank with said at least two opposed wall regions disposed at opposite ends thereof forming a pair of end covers.

4. A composite pressure vessel, as defined in claim 1, wherein said apertures are sealed with a resin material after said single fiber is threaded between said at least two opposed wall regions.

5. A composite pressure vessel, as defined in claim 1, wherein said internal fibers are formed from Kevlar.

6. A composite pressure vesel, as defined in claim 1, wherein said apertures are spaced such that two adjacent said apertures define a cross-section therebetween having smooth rounded corners over which said single fiber is placed when said single fiber is threaded from one aperture to an adjacent aperture.

7. A composite pressure vessel, as defined in claim 1, wherein said apertures are spaced apart on a matrix defined by the shape of said wall region.

8. A composite pressure vessel, as defined in claim 1, wherein said top, bottom, and side walls are joined at spaced apart 90 degree edges thereof.

9. A composite pressure vessel, as defined in claim 1, wherein said at least two opposed wall regions are top and bottom end caps, and a cylindrical side wall therebetween is joined to said top and bottom end caps at spaced apart edges thereof, selected from the group consisting of 90 degree edges, beveled edges and complementary stepped edges.

10. A composite pressure vessel, as defined in claim 1, wherein said plurality of internal fibers comprise a material which does not corrode or react with the fluid carried in said composite pressure vessel.

11. A composite pressure vessel as defined in claim 1, wherein said internal fibers are in the form of a twisted fiber strand.

12. A composite pressure vessel, as defined in claim 1, further comprising: encircling reinforcing fibers disposed about the outer periphery of said pressure vessel and in contact therewith.

13. A composite prssure vessel, as defined in claim 12, wherein said encircling fibers are impregnated with a resin material.

14. A composite pressure vessel, as defined in claim 12, wherein said encircling reinforcing fibers are formed from fiberglass.

15. A composite pressure vessel, as defined in claim 12, wherein said encircling fibers are disposed in two orthogonally disposed sets of fibers.

* * * * *